US009211050B2

(12) United States Patent
Fetzer et al.

(10) Patent No.: US 9,211,050 B2
(45) Date of Patent: Dec. 15, 2015

(54) STATIONARY HOUSEHOLD APPLIANCE, IN PARTICULAR A DISHWASHER

(75) Inventors: Gerhard Fetzer, Gundelfingen (DE); Dieter Hotz, Dischingen (DE); Cengiz Kücük, Syrgenstein (DE)

(73) Assignee: BSH Hausgeraete GmbH, Munich (DE)

( * ) Notice: Subject to any disclaimer, the term of this patent is extended or adjusted under 35 U.S.C. 154(b) by 1040 days.

(21) Appl. No.: 12/934,660

(22) PCT Filed: Mar. 27, 2009

(86) PCT No.: PCT/EP2009/053688

§ 371 (c)(1),
(2), (4) Date: Sep. 27, 2010

(87) PCT Pub. No.: WO2009/121813

PCT Pub. Date: Oct. 8, 2009

(65) Prior Publication Data

US 2011/0012486 A1 Jan. 20, 2011

(30) Foreign Application Priority Data

Mar. 31, 2008 (DE) ..... 10 2008 016 480

(51) Int. Cl.

| | |
|---|---|
| ***A47L 15/42*** | (2006.01) |
| ***F24C 15/02*** | (2006.01) |
| *E05D 11/00* | (2006.01) |

(52) U.S. Cl.

CPC ..... *A47L 15/4261* (2013.01); *A47L 15/4255* (2013.01); *E05D 11/0054* (2013.01); *F24C 15/023* (2013.01); *E05D 2011/0072* (2013.01)

(58) Field of Classification Search

CPC ..... E05D 2011/0072; E05D 2011/0054; F24C 15/023; A47L 15/4255; A47L 15/4261; A21B 3/02

USPC ..... 134/56 D, 57 D, 57 DL, 58 D, 58 DL; 312/228, 237; 126/194; 49/384, 383

See application file for complete search history.

(56) References Cited

U.S. PATENT DOCUMENTS

| | | | | | |
|---|---|---|---|---|---|
| 1,678,855 | A | * | 7/1928 | Forshee | 126/191 |
| 2,776,655 | A | * | 1/1957 | Ferguson, Jr. et al. | 126/194 |
| 2,958,911 | A | * | 11/1960 | Given et al. | 52/792.1 |
| 3,117,582 | A | * | 1/1964 | Perl | 134/94.1 |
| 3,155,088 | A | * | 11/1964 | Barber | 126/194 |
| 3,327,701 | A | * | 6/1967 | Gibbons | 126/194 |
| 3,398,735 | A | * | 8/1968 | Barber | 126/191 |
| 3,437,087 | A | * | 4/1969 | Price | 126/191 |
| 3,842,542 | A | * | 10/1974 | White et al. | 49/386 |
| 4,138,988 | A | * | 2/1979 | Hurley | 126/194 |
| 4,765,697 | A | * | 8/1988 | Gardell et al. | 312/229 |

(Continued)

FOREIGN PATENT DOCUMENTS

| | | | |
|---|---|---|---|
| DE | 8900298 | U1 | 10/1989 |
| DE | 4446961 | A1 | 7/1996 |

(Continued)

*Primary Examiner* — Joseph L Perrin
*Assistant Examiner* — Kevin G Lee
(74) *Attorney, Agent, or Firm* — James E. Howard; Andre Pallapies

(57) ABSTRACT

A stationary household appliance having a door that is pivotably mounted on the stationary household appliance by a joint. The stationary household appliance also has a noise damper that is provided in a region of the joint.

25 Claims, 3 Drawing Sheets

(56) References Cited

U.S. PATENT DOCUMENTS

| | | | | |
|---|---|---|---|---|
| 4,940,298 | A * | 7/1990 | Jackson et al. | 312/228 |
| 7,334,589 | B2 | 2/2008 | Jordan et al. | |
| 7,409,959 | B2 | 8/2008 | Retsema | |
| 7,867,340 | B2 * | 1/2011 | Pyo et al. | 134/25.2 |
| 7,987,554 | B2 * | 8/2011 | Hakamata et al. | 16/250 |
| 2004/0172787 | A1 * | 9/2004 | Collene et al. | 16/289 |
| 2005/0257816 | A1 * | 11/2005 | Kim | 134/200 |
| 2007/0272285 | A1 | 11/2007 | Herreman et al. | |
| 2008/0236637 | A1 | 10/2008 | Pyo et al. | |
| 2008/0238274 | A1 | 10/2008 | Seo et al. | |
| 2010/0012411 | A1 * | 1/2010 | Fiacchino et al. | 180/89.11 |

FOREIGN PATENT DOCUMENTS

| | | | |
|---|---|---|---|
| DE | 19907144 | A1 | 8/2000 |
| DE | 102007032758 | A1 | 1/2009 |
| EP | 0711527 | A1 | 5/1996 |
| GB | 2235723 | A * | 3/1991 |

* cited by examiner

STATIONARY HOUSEHOLD APPLIANCE, IN PARTICULAR A DISHWASHER

BACKGROUND OF THE INVENTION

The invention relates to a stationary household appliance, in particular a dishwasher.

Undesirable noise emissions occur during the operation of stationary household appliances, in particular dishwashers.

BRIEF SUMMARY OF THE INVENTION

It is therefore the object of the invention to provide a stationary household appliance in which the noise emissions during operation are reduced.

The invention is based on a stationary household appliance, in particular a dishwasher having at least one door, which is pivotably mounted by means of a joint on the stationary household appliance.

A noise damping means are provided in the region of the joint. The noise damping means close, at least partially, for example slotted openings in the region of the joint through which otherwise noise emissions would be able to pass unhindered. In this way, this surprisingly simple measure is able to achieve a significant reduction in the noise emissions.

It is preferably provided that the joint comprises at least one hinge lever associated with the household appliance and one hinge support associated with the door which are pivotably engaged with each other about an axis of rotation.

Hereby, it is preferably provided that the noise damping means is disposed on the hinge support, i.e. permanently installed.

In addition, it is preferably provided that the noise damping means comprises at least one noise damping wall.

The noise damping wall preferably extends from a basic element of the noise damping means as far as the hinge support.

It is additionally preferably provided that the noise damping wall at least partially covers a hinge lever opening on the housing front in a noise exit direction.

In addition, it is preferably provided that the noise damping means comprises a force transmission element which transmits a force acting on the outer side of a housing wall of the stationary household appliance into components of the stationary household appliance.

It is additionally preferably provided that at least two force introduction regions for the transmission of force into at least two different components of the stationary household appliance are provided. In this way, at least two parallel force paths to the two different components are provided. The clamping forces introduced are hence divided between the at least two components so that overall the risk of damage to the components is reduced. The invention is applicable to all stationary household appliances, for example dishwashers, stoves/ovens, washing machines or dryers.

Preferably, a first force introduction region can be provided in a hinge support to which a pivotable hinge lever of a door of the stationary household appliance is attached. On the other hand, the second force introduction region can be provided in a front frame delimiting a loading opening of the stationary household appliance.

Preferably, the clamping forces can be introduced in further force paths into the stationary household appliance. For example, a third force introduction region can be provided in the hinge lever of the door. A fourth force introduction region can be provided in a base of the stationary household appliance.

The force transmission element can have one or more support elements protruding therefrom which are supported against the components of the stationary household appliance. To ensure uniform force introduction into the at least two different components, at least one support element can be associated with each of the force introduction regions. Hereby, in a simple exemplary embodiment from the point of view of production, the support elements associated with the force introduction regions can all be supported on the hinge support.

The stationary household appliance can have two opposing lateral hinge supports between which the door is provided. The two hinge supports disposed at a distance from each other can be connected to each other via a force transmitting cross-member, for example a plinth rail, which supports the two hinge supports against the clamping forces.

The force transmission element can have a plate-shaped basic element with at least one support element protruding therefrom, which can be supported on the stationary household appliance component. According to the invention, therefore, the force transmission element is not a compact component made of a solid material. Instead, the force transmission element with its plate-shaped basic element can be supported on the housing wall in order to avoid impressions on the housing wall. However, the force transmission element is not in contact with the entire area of the side facing the functional part, but, in accordance with the principle of lightweight construction, only with the at least one support element protruding from the plate-shaped basic element. This enables an overall weight saving, without—with appropriate dimensioning of the support element—any impairment of the functions of the force transmission element.

For further weight reduction and to increase strength, the plate-shaped basic element of the force transmission element can have framework-like reinforcing walls arranged, for example, in a type of honeycomb structure. Hereby, the reinforcing walls and the support element can be disposed on a common side surface of the basic element which is preferably facing away from the housing wall.

From the viewpoint of assembly technology, the force transmission element can preferably be made from a single material and embodied as a single piece and for example produced as a plastic or metal injection molded part. To reduce the number of components, latching elements can be integrally molded as a single piece on the force transmission element with which the force transmission element can be prefixed undetachably on the functional part. For a compact design, it is advantageous for the latching element to be directly molded onto the front-end surface of the support element of the force distributor.

As mentioned above, in particular suitable as functional parts in the housing interior for force introduction and/or for the attachment of the force transmission elements according to the invention are lateral hinge supports between which a door is pivotably mounted. In the case of a dishwasher, the door is pivotably mounted about a horizontal axis of rotation in order to open or close the front-opening washing compartment. The two lateral hinge supports are usually rigid, plate-shaped metal parts which are mounted in a bottom group in the dishwasher. Together with the interposed door mounted thereupon, the lateral hinge supports form an extraordinarily rigid structure in the device's lateral direction into which the lateral retention forces exerted from outside may be introduced without causing any damage.

Usually, the door is pivotably mounted by means of lateral hinge levers to journals which are mounted in the hinge supports. In addition, the door's two hinge levers can each have a lever arm which can be co-pivoted laterally along the hinge support. The lever arm can be connected to a compensation device, which exerts a compensation torque on the door, for example via a spring, which counteracts the door's gravity moment. By suitable dimensioning of the compensation device, the torques acting on the door are always in equilibrium regardless of the pivot position of the door.

The lever arm of the hinge lever of the door can be disposed in a lateral direction of the device between the respective hinge support and the force transmission element. In this case, the force transmission element can extend over the lever arm of the hinge lever like a hood. Here, the support element of the force transmission element should be disposed outside the lever arm's pivot path. In particular, a clearance can be provided between the force transmission element and the hinge support into which the lever arm of the hinge lever can be pivoted without impairment.

Preferably, in the region of the hinge lever, the base plate of the force transmission element can have a raised bearing contour. In normal condition, this can be disposed at a distance from the hinge lever and only on exposure to an external force on the force transmission element is it deformed in an elastically resilient manner until it comes into contact with the hinge lever. In this case, the lateral retention forces can be introduced into the rigid hinge structure directly via the hinge lever.

In finished assembled condition of the stationary household appliance, the lever arm of the door-side hinge lever protrudes through a hinge opening of a front frame part delimiting the washing compartment opening into the hinge support clearance and the clearance delimited by the force distributor. This clearance hence faces outward over the hinge opening. This means that operating noises in the interior of the housing can escape outward through the clearance and the front-side hinge opening toward the outside. To prevent this, the force transmission element can have noise damping walls that can extend preferably between the force transmission element and the hinge support. In this way, said clearance for the lever arm of the hinge lever can be separated from the housing interior. In addition, the noise damping walls can at least partially cover the front-side hinge opening which is a further means for preventing noise escaping from the device.

To further increase its rigidity, the plate-shaped basic element of the force distributor can have a side wall running around the edge. The basic element hence has an approximate shell-shape. When the force transmission element is installed, the flat shell base can be in contact with the side wall of the housing and the side wall running round the edge can protrude toward the functional part.

BRIEF DESCRIPTION OF THE DRAWINGS

The following describes an exemplary embodiment of the invention with reference to the attached figures, which show.

DETAILED DESCRIPTION OF EXEMPLARY EMBODIMENTS OF THE PRESENT INVENTION

Figure 1:
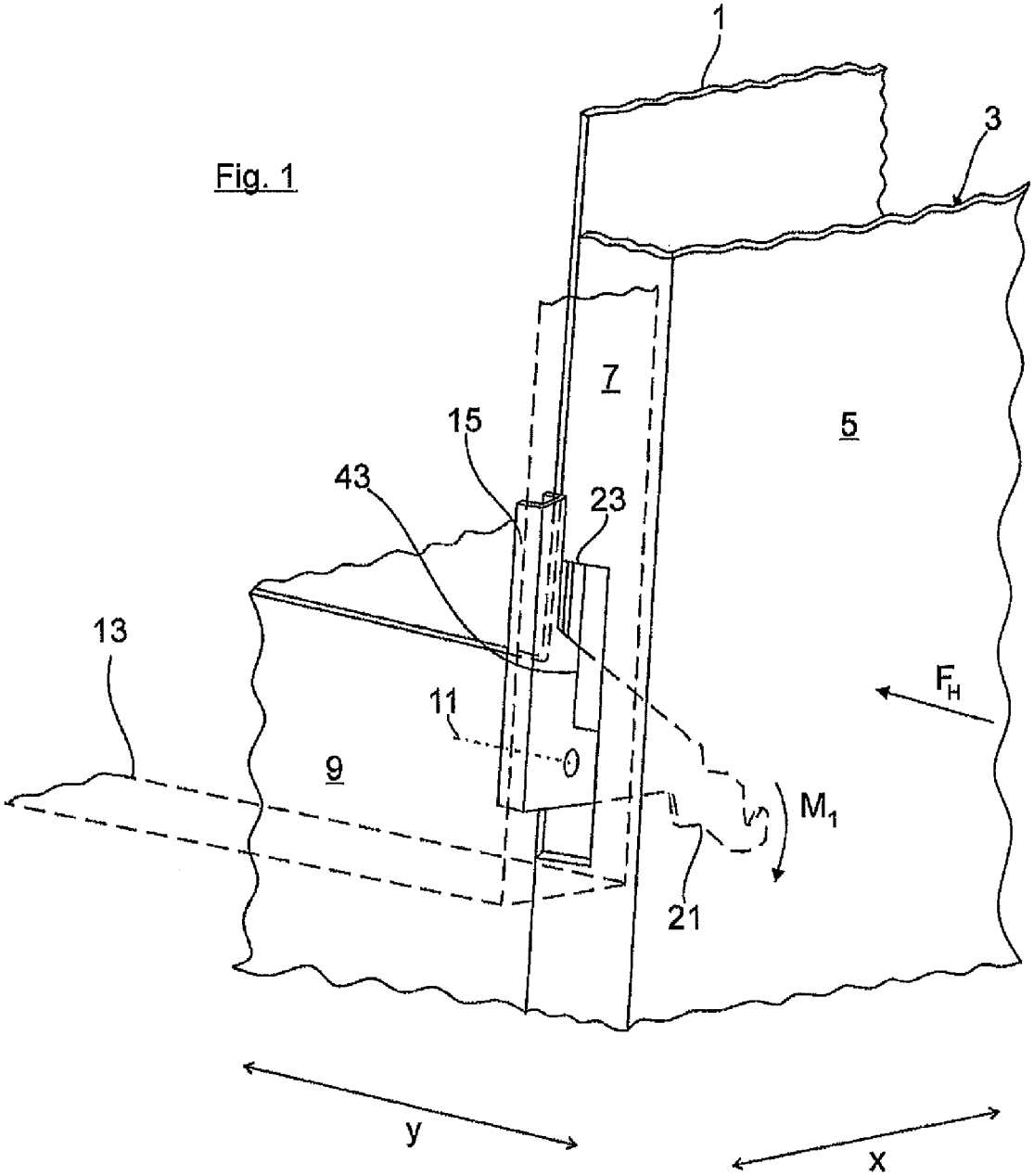
FIG. 1 in a perspective partial view, a dishwasher

FIG. 1 shows a perspective partial view of a dishwasher with a front-opening washing compartment 1. The washing compartment 1 is usually disposed in an outer housing 3 of the dishwasher. Of the outer housing 3, FIG. 1 only shows a housing side wall 5 and front frame elements 7, 9 which bound the frontal loading opening of the washing compartment 1. The frontal loading opening of the washing compartment 1 can be closed by means of a door 13 pivotably mounted about a horizontal axis of rotation 11—in FIG. 1 this door is only indicated by dotted lines.

Figure 2:
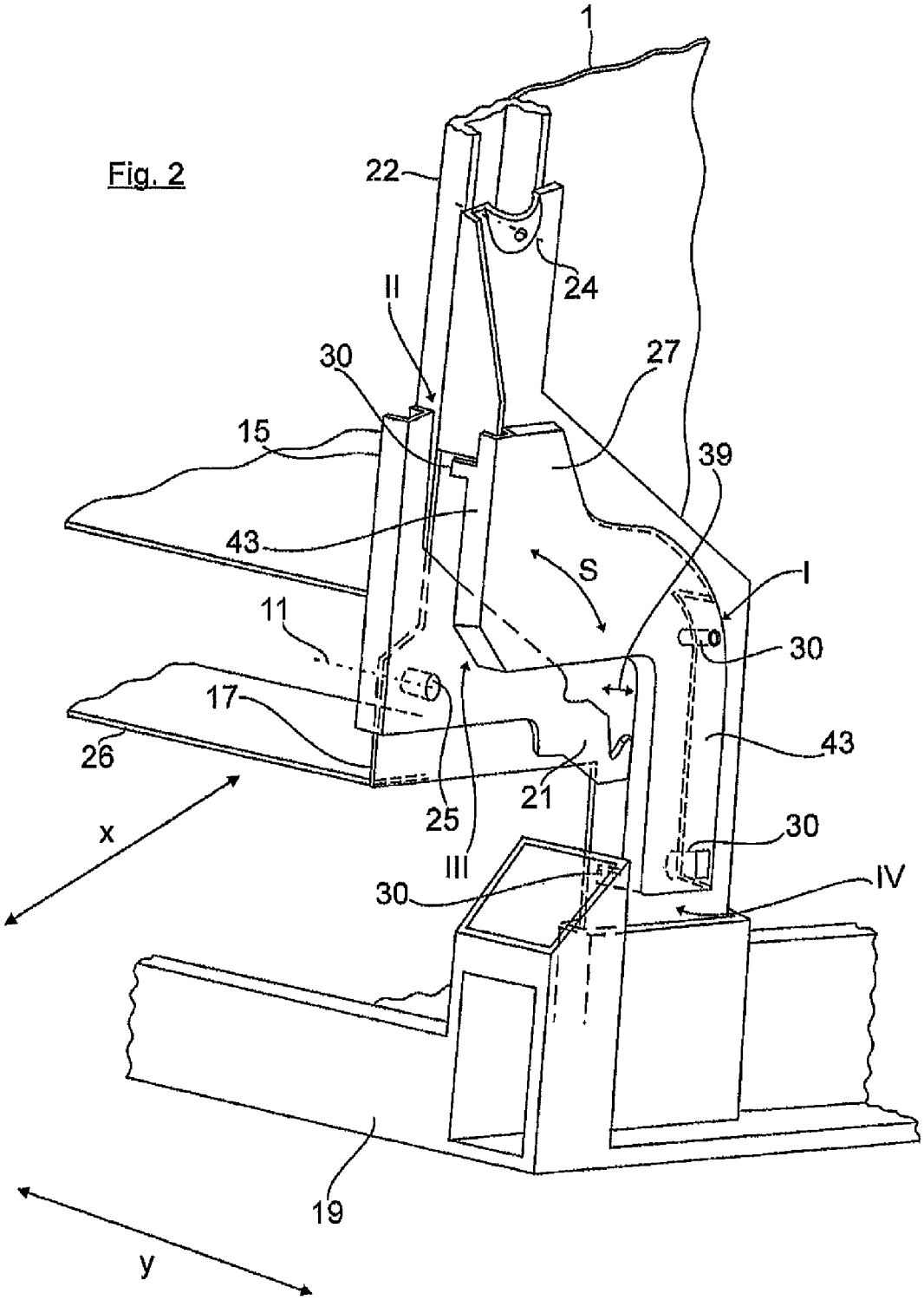
FIG. 2 in a further perspective view, a lateral hinge region of the dishwasher to which a door is attached and FIG. 3 a force distributor according to the invention on its own.

The door 13 is usually supported on both sides by means of hinge levers 15. The hinge levers 15 are in turn attached by journals 25 to lateral plate-shaped hinge supports 17, only one of which is shown FIG. 2. In FIG. 2, the hinge support 17 is a metal part with an approximately angular shape, the vertical limb of which is held laterally in a bottom group 19 of the dishwasher.

The hinge lever 15 of the door 13 has a lever arm 21 which protrudes laterally below the washing compartment 1 through a hinge opening 23 of the perpendicular front frame part 7 into the interior of the housing. The lever arm 21 is effectively connected to a compensation device (not shown), which exerts a compensation torque $M_1$ on the door 13 in the clockwise direction, which counters the gravity moments of the door 13 acting in the counterclockwise direction. In both FIGS. 1 and 2, only the right hinge region of the dishwasher is shown. The corresponding left hinge area (not shown) has an identical design.

As is further evident from FIG. 2, the hinge lever 15 is pivotably mounted in the lateral direction y on the side outside of the hinge support 17 on its journal 25. Hereby, the lever arm 21 of the hinge lever 15 moves along an outer side surface of the hinge support 17. The two hinge supports 17, each disposed in the lateral region of the dishwasher, form together with the intermediate door 13 a hinge structure which is overall very rigid in the lateral direction y. This is able to absorb retention forces $F_H$ acting laterally on the opposing side walls 5 during transportation without damage.

According to FIG. 2, the frontal loading opening of the washing compartment 1 is bounded by a front frame 22. This is usually supported on its lateral frame strip shown in FIG. 2 on the hinge support 17. For a firm connection with the hinge support 17, the front frame 22 is screwed to the hinge plate 17 by an indicated screwed connection 24.

The two lateral hinge supports 17 are also connected to each other below the washing compartment base by means of a cross-member, i.e. the indicated plinth rail 26. The flat plinth rail 26 closes an assembly opening to the motor compartment toward the front. The plinth rail 26 also provides noise damping and can be provided with a suitable damping layer, for example a bitumen layer.

To introduce the retention force $F_H$ from the respective housing side wall 5 into the dishwasher, according to FIG. 2 a force transmission element 27 is provided which absorbs a retention force $F_H$ acting from outside on the side wall 5 and conducts them into the interior of the dishwasher.

According to FIG. 2, the force transmission element 27 is supported on the outside by support elements 30 on the hinge support 17 shown. The support elements 30 are hereby divided in a wide area over the entire hinge support 17 in such a way that the associated force introduction regions I, II, III, IV are associated with different components, i.e. the hinge support 17, the front frame 22 of the washing compartment 1, the bottom group 19 and the hinge lever 15.

The first force introduction region I is hereby associated with the hinge support 17, while the second force introduction region II is associated with the front frame 22. On the other hand, the third force introduction region III is associated with the hinge lever 15 of the door 13 and the fourth force introduction region IV is associated with the bottom group 19.

This ensures that it is not only one single component that is exposed to the clamping force $F_H$. Instead, the force introduction regions I, II, III, IV provide force paths extending in parallel to each other by means of which the clamping forces $F_H$ are divided between the hinge plate 17, the bottom group 19, the front frame 26 and the hinge lever 15.

Figure 3:
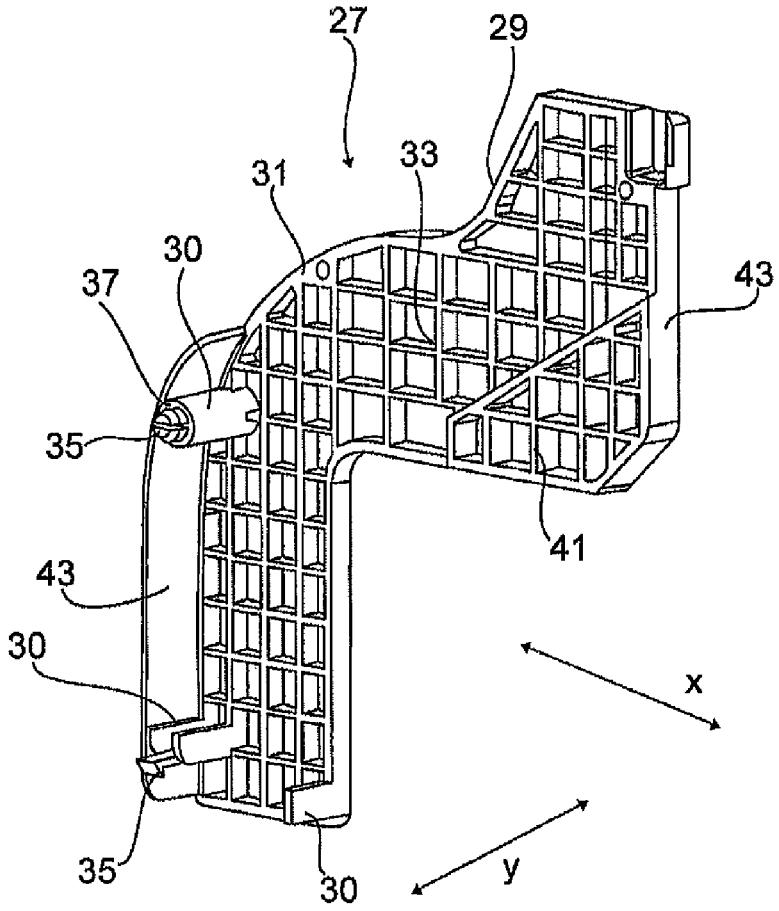

The force distributor or the force transmission element 27 is shown on its own in FIG. 3. Here, the force distributor 27 is a single-piece and single-material plastic molded part. Overall, the geometric design of the force distributor 27 has a lightweight construction. To this end, the force distributor 27 has a plate-shaped basic element 29 and support elements 30 protruding therefrom. The plate-shaped basic element 29 has an enclosed smooth surface facing the side wall 5 to avoid impressions or dents in the side wall 5 during transportation. The enclosed smooth surface of the force distributor 27 is bounded by a side wall 31 running round the edge, which protrudes in the direction of the hinge support 17. Together with the enclosed smooth outer surface of the force distributor 27, the side wall 31 running round the edge overall forms an approximately shell-shaped structure, in which framework-like reinforcing walls 33 extend.

According to FIG. 3, the support elements 30 of the force transmission element 27 protruding from the basic element 29 have different embodiments. For example, a first support element 30 is designed as a cylindrical latching dome with a latching element 35 molded-on in the center of its front side facing the hinge support 17. The latching element 35 is surrounded by a ring surface 37 which is supported on the hinge support 17. The second support element 30 has two supporting bars disposed at distance from each other between which a further latching element 35 is disposed protruding over the two bars in the direction of the side of the device y. The two latching elements 35 can engage in corresponding latch openings in the hinge support 17. The third support element 30 is embodied without an additional latching element 35 and is solely supported on the side surface of the hinge support 17.

In FIG. 2, the force distributor 27 is shown as laterally latched to the hinge support 17. The plate-shaped basic element 29 is hereby disposed with a clearance 39 from the hinge support 17 by means of the support elements 30. According to FIG. 2, the lever arm 21 of the hinge lever 15 protrudes into the clearance 39 formed between the hinge support 17 and the force transmission element 27. The support elements 30 are hereby positioned in such a way that they do not impede the pivot path S of the hinge lever 21.

As is further shown in FIG. 3, in addition to the support elements 30, there is also a bearing contour 41 raised from the reinforcing walls 33. In normal condition, the bearing contour 41 is disposed at a distance from the lever arm 21 of the hinge lever 15 in order not to impede the door's pivot motion. On exposure to force in the form of the lateral retention force $F_H$, the force distributor is deformed in an elastically resilient manner in the region of the bearing contour 41 until it comes into contact with the lever arm 21. This enables the retention force $F_H$ to be also conducted via the hinge lever 15 into the hinge support 17.

The clearance 39 provided between the force distributor 27 and the hinge support 17 is open to the outside via the hinge opening 23 in the front frame part 7. Operating noises from the housing interior are conducted undamped outward through the hinge opening 23. In order to reduce the noise here, the force distributor 27 has noise damping walls 43. Of the noise damping walls 43, a first wall is disposed in the depth direction x on the rear side of the force distributor 27 and separates the clearance 39 to the rear from the housing interior. According to FIGS. 1 to 3, in addition, a vertical section of the side wall 31 disposed at the front in the depth direction x also serves as a noise damping wall 43. According to FIG. 1, the front noise damping wall 43 of the force distributor 27 partially covers the hinge opening 23 of the front frame part 7, which also reduces the emission of noise.

LIST OF REFERENCE NUMBERS

1 Washing compartment
3 Outer housing
5 Housing wall
7,9 Front frame parts
11 Axis of rotation
13 Door
15 Hinge lever
17 Hinge support
19 Bottom group
21 Lever arm of the hinge lever 15
22 Front frame
23 Hinge opening
24 Screwed connection
25 Journal
26 Plinth rail
27 Force distributor or force transmission element
29 Plate-shaped basic element
30 Support elements
31 Side wall running along edge
33 Reinforcing walls
35 Latching elements
37 Ring surface
39 Clearance
41 Bearing contour
43 Noise damping walls
y Lateral direction
x Direction of depth
S Pivot path
$M_1$ Compensation torque
$F_H$ Retention force
I,II,III,IV Force introduction regions

The invention claimed is:

1. A stationary household appliance, comprising:

an outer housing which encloses a washing compartment, the outer housing including a hinge opening formed therein;

a joint including at least one hinge lever and at least one hinge support, the hinge lever protruding through the hinge opening, the hinge support being fixedly attached to a bottom portion of the household appliance, the hinge lever and the hinge support being pivotably engaged with each other about an axis of rotation;

a door pivotably mounted on the stationary household appliance by the joint, the door being supported by the hinge lever; and a plate-shaped element supported by the hinge support and extending vertically in side-by-side arrangement with the hinge support, the plate-shaped element including a first noise damper formed thereon in a region of the joint, the first noise damper at least partially covering the hinge opening, wherein the plate-shaped element has a plurality of support elements protruding laterally therefrom, at least two of the support elements engage the hinge support such that the plate-shaped element is disposed in side-by-side arrangement with the hinge support with a lateral clearance space from the hinge support, the hinge layer extends into the clearance space, the plate-shaped element has a second noise damper provided on the plate-shaped element spaced away from the hinge opening and on a side opposite the first noise damper, the first noise damper being adjacent the hinge opening, the second noise damper extends from the plate-shaped element to the hinge support, and the plate-shaped element is installed on the hinge support, and the first noise damper has a noise damping wall extending vertically along the hinge support and positioned to oppose the hinge opening along a height thereof.

2. The stationary household appliance of claim 1, wherein the stationary household appliance is a dishwasher.

3. The stationary household appliance of claim 1, wherein, in a noise exit direction, the noise damping wall at least partially covers a hinge lever opening on a housing front of the stationary household appliance.

4. The stationary household appliance of claim 1, wherein the plate-shaped element includes a force transmission element which transmits a force acting on an outer side of a housing wall of the stationary household appliance into components of the stationary household appliance.

5. The stationary household appliance of claim 4, wherein the force transmission element has at least two force introduction regions for transmitting the force into at least two different ones of the components of the stationary household appliance.

6. The stationary household appliance of claim 5, wherein a first force introduction region of the at least two force introduction regions is provided in the hinge support.

7. The stationary household appliance of claim 5, wherein a second force introduction region of the at least two force introduction regions is provided in a front frame delimiting a loading opening of the stationary household appliance.

8. The stationary household appliance of claim 5, wherein a third force introduction region of the at least two force introduction regions is provided in the hinge lever.

9. The stationary household appliance of claim 5, wherein a fourth force introduction region of the at least two force introduction regions is provided in a base of the stationary household appliance.

10. The stationary household appliance of claim 5, wherein the force transmission element has a support element that protrudes from the force transmission element, and wherein the support element is associated with a respective one of the at least two force introduction regions.

11. The stationary household appliance of claim 10, wherein the support element is supported on the hinge support.

12. The household appliance of claim 5, wherein the at least one hinge support includes two opposing hinge supports, wherein an intermediate door is arranged between the two opposing hinge supports, wherein the two opposing hinge supports are connected by a plinth rail.

13. The stationary household appliance of claim 5, wherein the force transmission element has a curved shape.

14. The stationary household appliance of claim 13, wherein the plate-shaped element has framework-like reinforcing walls.

15. The stationary household appliance of claim 14, wherein the framework-like reinforcing walls and a support element of the force transmission element are disposed on a common side surface of the plate-shaped element.

16. The stationary household appliance of claim 15, wherein a side of the plate-shaped element facing away from the support element is opposite an outer wall of the outer housing of the stationary household appliance.

17. The stationary household appliance of claim 16, wherein the force transmission element is one of a plastic injection molded part and a metal injection molded part.

18. The stationary household appliance of claim 5, wherein the force transmission element has a plurality of latching elements for latching connection with a component of the stationary household appliance.

19. The stationary household appliance of claim 18, wherein each of the plurality of latching elements is integrally molded as at least one of a single material and a single piece on a support element of the force transmission element.

20. The stationary household appliance of claim 19, wherein the support element has a front-side support surface onto which a respective one of the plurality of latching elements is integrally molded.

21. The stationary household appliance of claim 5, wherein the force transmission element has a plate-shaped element, and wherein the plate-shaped element has a side wall running around an edge of the plate-shaped element.

22. The stationary household appliance of claim 1, wherein the hinge lever has a lever arm that is connected to a compensation device that exerts a compensation torque on the door to counteract a gravity torque of the door.

23. The stationary household appliance of claim 22, wherein the lever arm of the hinge lever is disposed between the hinge support and a force transmission element of the plate-shaped element.

24. The stationary household appliance of claim 10, wherein the support element of the force transmission element is disposed outside of a pivot path of a lever arm of a hinge lever.

25. The stationary household appliance of claim 1, wherein the plate-shaped element has, in a region of the hinge lever, a raised bearing contour which is, in a normal condition, remote from a lever arm and which is, on exposure to force from a retention force, deformed in an elastically resilient manner until the bearing contour comes into contact with the hinge lever.

* * * * *